US007168884B2

(12) United States Patent
Hart

(10) Patent No.: US 7,168,884 B2
(45) Date of Patent: Jan. 30, 2007

(54) REINFORCED PERMEABLE PAVING STRUCTURE

(75) Inventor: Peter Hart, Bath (GB)

(73) Assignee: Formpave Holdings Ltd., Gloucestershire (GB)

( * ) Notice: Subject to any disclaimer, the term of this patent is extended or adjusted under 35 U.S.C. 154(b) by 0 days.

(21) Appl. No.: 10/450,764

(22) PCT Filed: Dec. 28, 2001

(86) PCT No.: PCT/GB01/05790

§ 371 (c)(1),
(2), (4) Date: Oct. 14, 2003

(87) PCT Pub. No.: WO02/081822

PCT Pub. Date: Oct. 17, 2002

(65) Prior Publication Data

US 2004/0067103 A1 Apr. 8, 2004

(30) Foreign Application Priority Data

Apr. 6, 2001 (GB) ..... 0108701.4

(51) Int. Cl.
*E01C 3/00* (2006.01)

(52) U.S. Cl. ..... 404/29; 404/28; 404/31

(58) Field of Classification Search ..... 404/28, 404/29, 30, 31, 70
See application file for complete search history.

(56) References Cited

U.S. PATENT DOCUMENTS 890,902 A * 6/1908 Hassam ..... 404/70
1,365,687 A * 1/1921 Hassam ..... 404/30
1,707,939 A * 4/1929 Mackenzie ..... 404/70
3,091,998 A * 6/1963 Wehr et al. ..... 404/70
3,870,422 A * 3/1975 Medico, Jr. ..... 404/31
4,523,755 A * 6/1985 Turba ..... 472/92
5,281,047 A * 1/1994 Skaug ..... 404/42
5,320,447 A * 6/1994 Ubero ..... 404/31
5,851,089 A * 12/1998 Beretta ..... 405/259.1

FOREIGN PATENT DOCUMENTS

WO WO-92 08846 A1 5/1992
WO WO-96 12067 A1 4/1996

* cited by examiner

*Primary Examiner*—Gary S Hartmann
(74) *Attorney, Agent, or Firm*—Darby & Darby

(57) ABSTRACT

A paving structure (11) of the type having an upper wear layer (12) and an underlying sub-base layer (15) of rigid insoluble hard particulate material forming voids for the collection of water permeating through the permeable surface where layer (12) has an intermediate reinforcing grid (16) located at an intermediate level of the sub-base layer (15) such that it is covered by an upper part of the sub-base layer (15U) which is of a thickness not less than 1½ times the dimension of the largest particles in that part of the sub-base layer. A reinforcing grid (26) at the base of the sub-base layer between this and the sub grade (18) may also be provided.

30 Claims, 4 Drawing Sheets

REINFORCED PERMEABLE PAVING STRUCTURE

The present invention relates to a reinforced permeable paving structure, and in particular to a paving structure which allows the retention or detention of rainfall or other precipitation falling on it or infiltration of collected water into the sub-grade as desired, whilst nevertheless being able to withstand high loads from heavy vehicular traffic.

Urban and industrial development results in the almost total coverage of the natural ground surface with impermeable materials. These may take the form of buildings (the impermeable surface effectively being the roof of the building), or walkway or roadway surfaces, which are required for easy transport by wheeled vehicles. A hard smooth surface capable of withstanding the load applied by vehicle wheels without the formation of depressions or ruts is needed for all areas likely to be the subject of vehicular traffic.

It is known that in order to prevent pooling during periods of rainfall such paved or tarmac surfaces must be laid with a 'fall' to allow surface water to run off in a predetermined direction to water collection and/or drainage systems leading to watercourses for the disposal of storm water during inclement weather. Drainage systems are generally built to cope with a maximum expected precipitation, which may be exceeded from time to time. It is known that meteorological events such as rainfall, although having an 'average' value over a period of time, necessarily involve peaks, which can be classified by the frequency with which they occur, higher peaks being less frequent. Drainage systems are consequently designed to cope with the peak rainfall which may occur, for example, once every thirty years or once every fifty years.

With the climatic changes which have been occuring in recent years the assumptions on the basis of which drainage systems have been built in the past are proving to be incorrect and the failure or overload of such systems is becoming increasingly frequent. Upgrading of drainage systems to cope with increased amounts of run-off is extremely costly.

Motor vehicles also introduce another damaging influence due to the pollution and contamination introduced into the atmosphere during their operation. Pollutants typically caused by motor traffic include heavy metals, hydrocarbons, rubber dust, silt and other fine detritus, which become deposited on the surfaces of roadways and car parks. During fine weather these materials collect and lie on the surface, only to be washed off in relatively high concentration during periods of heavy rain. Many of these polluting materials are washed into watercourses and from there to the sea, polluting both on a long term basis. Even in areas where such run-off is passed through a treatment plant before being released to the natural watercourses a certain proportion of the pollutants nevertheless pass through untreated and, of course, the cost of operating such plant has to be borne by the local community.

Various proposals have been made in the past for ameliorating both of these problems by the provision of permeable roadways and parking areas which behave in a more natural manner allowing rainfall and other precipitation to pass through the surface into subterranean collection regions rather than being allowed to run off the surface into drains. One such proposal is described, for example, in International Patent Application Publication No. WO 96/12067 which describes a paving system having a permeable pavement covering a sub-base layer of mainly hard nodules, the whole being laid over an impervious membrane to provide temporary storage in the interstices for chemical spillage or flood water. Pollutants can be treated chemically or decomposed biologically, and the rate of flow from the storage area can be regulated by providing suitable valve control means.

The wear surface of the paving system may be permeable tarmac having passages through it or individual blocks, typically of concrete or other such material, which have passages either within them or between them to allow water to pass through rather than being retained on the surface. The sub-base layer is made from non-friable particulate material which, when compacted, retains enough voids between the particles to hold water up to a given percentage. The sub-base and the underlying impermeable membrane forms in effect a subterranean cistern capable of holding a large quantity of water but which is itself load-bearing and capable of supporting wheeled vehicular traffic. If the sub-grade is suitable the sub-base may be laid directly on it without an impermeable barrier so that water collecting in the sub-base can infiltrate gradually into the sub-grade.

One of the problems associated with the known structures lies in the fact that heavy goods vehicles such as road transport lorries and the like apply through each individual wheel a load on the surface of the ground over which they pass or on which they stand which is much greater than the majority of pavement structures are capable of supporting. This results in localised displacement of the wear surface, rutting and collapse of the bearing layer. In order to be able to function properly and effectively it is necessary for the sub-base layer to be compacted to a point at which the individual stones or particles interlock with one another to hold the surface of the layer in a substantially rigid non-plastic manner, but apart from a compacting operation nothing can be done to increase the resistance of particles to displacement under an excessively heavy load. It is essential that the nature of the particles be such that they leave voids between them for the accommodation of rainfall or other run-off in order for the permeable pavement to function. Compaction to the point where all voids between the particles are removed, whilst it would increase the load-bearing capacity, conflicts with the requirement for the voids to be present in order to accommodate the water. This limitation on the structural strength of the sub-base is layer of this earlier arrangement makes pavement structures formed according to this earlier arrangement unsuitable for vehicles over a given axle loading.

The present invention seeks to provide an improved permeable paving structure capable of withstanding higher loads without detrimentally affecting the storage capacity of the sub-base reservoir, and without requiring the use of more material in the sub-base layer.

According to one aspect of the present invention, therefore, a paving structure having a system for collecting and retaining or at least detaining rainfall or other precipitation in an area subject to vehicular traffic, and comprising a permeable surface wear layer and an underlying sub-base layer of rigid insoluble hard particulate material is characterised in that a reinforcing grid is located at an intermediate level spaced from the top of the said underlying layer at a depth not less than one and a half times the dimension of the largest particles in the said underlying sub base layer.

It is of course known to utilise so-called geogrids to stabilise loose-laid bulk material.

It is known for such geogrids to be laid at an interface between, for example, the sub-grade and the sub-base in a roadway structure. The US Department of Transportation, Federal Aviation Administration has produced a report based on a study of grid-reinforced aggregate base courses for general aviation airports in which a number of different combinations of base courses and geogrid test sections were investigated. Geogrids are deformed or non-deformed grid-like polymeric materials formed by intersecting ribs joined at the junctions. Geogrids are known for use in reinforcement of foundations, soil, rock, earth or other geotechnical engineering material as an integral part of a man-made project, structure or system. In particular, areas such as geogrid ballast reinforcement for railroad track bed, reinforcement for aggregate surfaced pavements, and reinforcement for flexible pavements were investigated. The term 'flexible pavements' refers to a structure having an asphalt course laid over compacted aggregate layers on a sub grade of relatively low strength as measured by the California Bearing Ratio (CBR) of 1.5 to 5%.

On the other hand, paving structures formed in accordance with the present invention may typically require sub-grade strengths having a CBR of 15% or more. The test results from the above investigation appear to demonstrate that in such circumstances the best improvement is achieved by the use of a geogrid at the interface between the sub-grade and the sub-base, namely at the bottom of the sub-base. This is the location for geogrids in other known applications where, as mentioned above, they are typically located at an interface between two layers of a different nature.

By contrast, in the paving structure of the present invention the geogrid is not located at an interface between a sub grade and a laid but is located within the thickness of a constructed sub-base layer. This has been found to bind the larger particles of the sub-base layer sufficiently firmly to allow an increase in the weight of traffic using the permeable pavement without any damage to the surface by displacement of the particles of the sub-base layer.

It is preferred that the material of the sub-base layer contains angular elements with well defined edges, in the form of non-rounded particles of crushed gravel, rock or concrete in a size range up to 100 mm. It is preferred that not more than 70% of the sub-base material lies in the range 37.5 mm–100 mm, and preferably not less than 40% of the said underlying material lies in this range. The reinforcing grid is preferably located at a level not less than one half of the thickness of the sub-base layer from the upper surface thereof. Typically, this may be in the region of 150 mm from the top of a layer in the region of 350 mm thick. For thicker sub-base layers greater than this value a second reinforcing grid of interconnected elements may be provided at a lower level than the said reinforcing grid, and the second reinforcing grid may be lower than the mid level of the layer. The size of the grid openings is preferably not greater than the size of the largest particles of the underlying sub-base layer. In one embodiment the size of the grid opening is not greater than the size of the majority of the particles in the said underlying layer.

For the best performance using the least material it is presently considered that the sub-base layer below the said reinforcing grid should be composed of particulate material in a generally larger size range than that in the layer above the said reinforcing grid. It is preferred that the largest particles of the material of the sub-base layer below the reinforcing grid are in the region of three times larger than the largest particles in the sub-base layer above the reinforcing grid. Likewise the smallest particles in the sub-base layer below the reinforcing grid are preferably not less than twice the size of the smallest particles in the sub-base layer above the reinforcing grid.

In a preferred paving structure there is an intermediate layer of particulate material between the surface or wear layer and the said underlying or sub-base layer. The average particle size of the particulate material in the said intermediate layer is preferably less than the average particle size of the elements of the said underlying or sub-base layer. This intermediate layer may be considered as a so-called 'bedding layer' which, during construction of the paving structure is laid to a flat, preferably horizontal surface prior to laying the individual paving blocks or elements which form the wear surface. The blocks are then vibrated with a vibrator to obtain a flat final regular surface. The average particle size of the intermediate layer may be in the region of 2 mm–10 mm, preferably in the region of 5 mm. In one embodiment the particulate material of the underlying or sub-base layer may have a minimum 10% fines value of 150 K/n. This can be tested in accordance with British Standard 812 Part 3 and is a measure of the resistance of the material to crushing. The substantial rigidity of the material can be tested by establishing that it is non-plastic in accordance with British Standards Test BS 1377 Test 4.

The reinforcing grid may be one having a substantially rectangular grid structure extending in two orthogonal directions with substantially the same resistance to stress in each of the said two orthogonal directions. The links or arms of the grid may be joined together at intersections to form a substantially laminar sheet, or the grid may be monolithic. Preliminary stretching of the grid in one or both directions on manufacture may be undertaken in order to increase its mechanical strength.

According to another aspect the invention provides a method of laying a permeable pavement structure as defined hereinabove, comprising the steps of preparing a sub-grade, laying a permeable geotextile or impermeable membrane thereon, applying a first layer or "lift" of the said underlying layer, compacting this layer to refusal with a vibrator, laying a reinforcing grid onto the first layer or "lift" of the underlying layer, applying a second layer or "lift" of the said underlying layer, compacting the underlying layer to refusal with a vibrator, laying a permeable geotextile over the said underlying layer, applying an intermediate layer over the said permeable geotextile, levelling the said intermediate layer without compaction thereof, applying a wear layer of individual elements over the intermediate layer and vibrating them and the said intermediate layer into their final position with a vibrator.

The compaction of the sub-base layers may be continued to the so-called point of refusal, that is until further treatment produces the further results. This, of course, relies somewhat on the subjective assessment of the operation. A degree of certainty can be introduced with the use of a nuclear Density Meter (a commercially available instrument) by the use of which the proportion of maximum compaction can be measured rather than assessed. It is preferred that the compaction be continued until reaching 95% of the compacted bulk density achievable under laboratory conditions.

Preferably a regulating layer of crushed particulate material the particle size of which is less than that of the larger particles of the said underlying layer but not less than 15% of the size of the largest particles of the said underlying layer, is applied to the upper surface of the second layer or "lift" of the said underlying or sub-base layer prior to compaction thereof whereby to provide a more uniform upper surface to receive the said permeable geotextile layer.

Likewise it is preferred that a dressing of clean single size angular stone of a size not greater than about 3 mm is applied over the blocks of the wear surface layer prior to the vibration thereof with the said vibrator.

Embodiments of the present invention will now be more particularly described by way of example, with reference to the accompanying drawings, in which.

Figure 1:
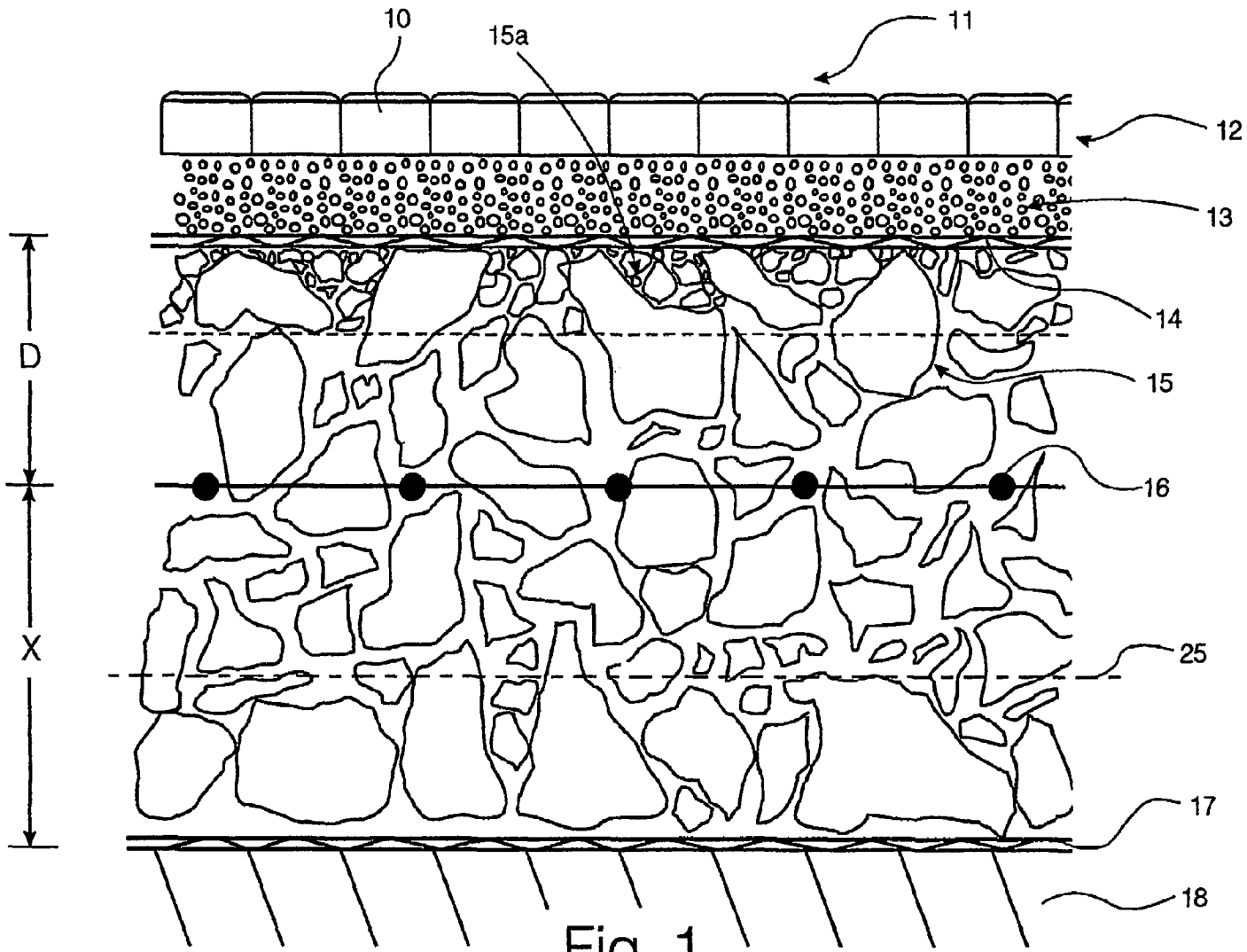
FIG. 1 is a cross section through part of an infiltration paving structure for disposal of collected water by infiltration to an appropriate sub-grade, and formed in accordance with the principles of the present invention.

Referring first to FIG. 1 a paving structure generally indicated 11 comprises an upper layer of blocks 12 which may be of the type described in the Applicant's International Patent Application published under no. WO 99/64680 that designated the U.S., entered National Stage, and issued as U.S. Pat. No. 6,939,077 the disclosure of which is incorporated herein by reference, which are substantially impermeable, but have grooves or channels in one or more lateral edges thereof to provide drainage passageways from the top to the bottom. In addition to an upper bevel which can be seen in the drawings, part of the upper side wall is tapered along the entirety of the edge between the upper surface and the lateral surface to allow a small degree of flexing of the overall surface by movement of the blocks upon the passage of heavy traffic. This helps to avoid spalling, and the channels provided by adjacent tapered surfaces also encourage the drainage of rainwater from the surface through the drainage channels into the underlying layers to be described in more detail below.

The blocks 12 are laid on an intermediate layer or bedding course 13 of fine particulate or granular material of a size in the region of 2 mm–10 mm, preferably up to 5 mm, which in turn is laid to tolerance on a geotextile membrane 14 itself overlying a sub-base layer generally indicated 15. The bedding layer is raked and levelled before the blocks 12 are laid on it, and blocks 12 are laid directly on the bedding layer 13 with no grouting or other filling (such as sand) either between themselves and the layer 13 or between each other so that there are no fine materials to wash down into the lower layers of the structure when rainfall infiltrates the passages between the blocks. After laying the blocks a vibrator is passed over the entire surface to settle the blocks and ensure they all lie to a common surface. Before or after this is done the block-paved surface may be dressed with a thin layer of fine clean stone in a size range about 2 mm–3 mm. These stones are then brushed into the interstices and help to lock the blocks in position against relative movement without clogging the passages through which the water drains into the underlying layer.

The sub-base layer 15 is composed of crushed gravel, rock, concrete or other hard insoluble particulate material having well-defined edges. It must be sound, clean, and non-friable and free from clay or other fine particulate material. This property allows the compaction of a layer typically in region of 350 mm to 400 mm thick, to a state in which it is capable of bearing the load of vehicular traffic such as motor cars, trucks and lorries. For this purpose the material must be non-plastic when tested in accordance with BS1377 Test 4. The material must also have a minimum 10% fines value of 150 K/n when tested in accordance with BS812 Part 3. In conducting such tests the samples must not be oven dried and should be soaked in water at room temperature for 48 hours before the test is conducted. This ensures that there are no variations between the performance of the material when wet and when dry as it must pass the test when effectively saturated.

The dimensions of the particles in the sub-base layer 15 may be up to 100 mm with up to 60% of the material being less than 37.5 mm and not more than 40% of the material being greater than 37.5 mm. Up to 20% of the material may be less than 20 mm with only 5% being less than 10 mm. This ensures that the material is permeable and, when compacted, nevertheless has a large proportion of void space between the particles. Typically 30% of the volume occupied by the layer 15 will be void space which is available for receiving water when the permeable paving structure is in use.

In order to enable the sub-base structure to carry heavier loads a reinforcing grid 16 is located at an intermediate level, at a distance typically 150 mm from the top of the sub-base, and in any event not less than one and half times the maximum particle size from the top of the sub-base layer to ensure that an adequate cover over the grid 16 is provided. In this case, the depth of the grid from the surface, indicated D in FIG. 1, is in the region of 150 mm, although it may be a little deeper with a positioning error of +/−10–15%. The overall thickness of the sub-base layer 15 may typically be in the region of 350 mm although greater or lesser thickness may be used if circumstances permit or dictate. This may be laid in two operations or 'lifts' with a lower layer being spread and preliminarily compacted first before the geogrid 16 is laid over it; the upper lift then spread over that. Final compaction to the required density state then follows.

Beneath the sub-base 15 is a geotextile layer 17 which separates the sub-base 15 from the sub-grade 18 which preferably should have a CBR (California Bearing Ratio) of at least 15%.

The geogrid 16 is preferably a polymeric plastics material of high strength, with a grid size typically in the region of 40 mm and reinforced junctions between the intersecting ribs. Grid sizes up to values in the region of 100 mm may also be utilised. Dimensions less than 40 mm are unlikely to be effective in allowing the necessary interlock between the upper and lower layers or 'lifts' of the sub-base 15.

It is believed that the reinforcement effect is achieved by forming in effect an intermediate stratum within the sub-base 15 which is more resistant to the relative movement of the particles of which it is composed than the remainder thereof due to the fact that particles in the upper layer or 'lift' can project down through the openings in the grid and also between the faces of other particles in the lower layer or 'lift', some of which project upwardly through the grid such that the forces exerted by wheeled traffic, and which might otherwise cause a lateral displacement of material beneath and to one side of it as it passes, are less able to cause such displacements due to the additional tensile effect of the ribs holding the particles of this intermediate stratum in place. Because the grid is located in the region of one and half times the maximum particle size from the top of the sub-base layer this interlock effect is achieved over substantially the entirety of the thickness of the upper lift of the sub-base, penetrating some distance below the grid, so that the intermediate stratum within the sub-base effectively acts as a stiffening layer of rigid material even though the particles have up to 30% void space between them. The upper layer or "lift of the sub-base 15 is compacted to refusal, that is compaction is continued until the point where further treatment has no further effect, or, if a Nuclear Density Meter is used to measure compaction, to a point greater than 95% of the laboratory achievable maximum. Even so the upper surface of the sub-base layer is very irregular with asperities and cavities due to the presence of the relatively large stones (up to 100 mm) in the material. In order to regularise this surface a regularisation layer 15*a* of clean crushed stone the particles of which are not greater than 20 mm and not less than 5 mm is applied to the top of the sub-base during or just before the vibrator is passed over it.

Rainfall or other precipitation (when melted) falling on the upper surface of the blocks 12 can infiltrate through the wear layer and the intermediate or bedding layer 13 which acts to trap many of the pollutants carried by the water. The effective storage volume of the sub-base layer allows the water to collect in this region, and then be diffused more gradually through the sub-grade which, in this embodiment, is assumed to be porous or to have sufficient faults to allow the water to permeate either through the ground downwardly or laterally through the edges of the storage region thus formed. The nature of the sub-base material 15 is such that, even when drained, the particles retain some moisture in pockets which ensures a humid atmosphere suitable for the growth of bacteria which can migrate upwardly through the geotextile 14 into the region of the bedding layer 13 to attack and break down certain of the pollutants trapped therein. Thus, as well as serving as a storm water control system the paving structure of the present invention also acts via bioremediation to degrade the entrapped hydrocarbons and other pollutants, which, together with the filtering action of the geotextile, cleans the water passing through the system. It is estimated that one square metre of the paving structure described above will cause up to 70 grams of oil per annum to be degraded and the water discharging from the structure, while not potable, can be used for many secondary purposes such as flushing lavatories, washing floors and cars or watering vegetation.

Figure 2:
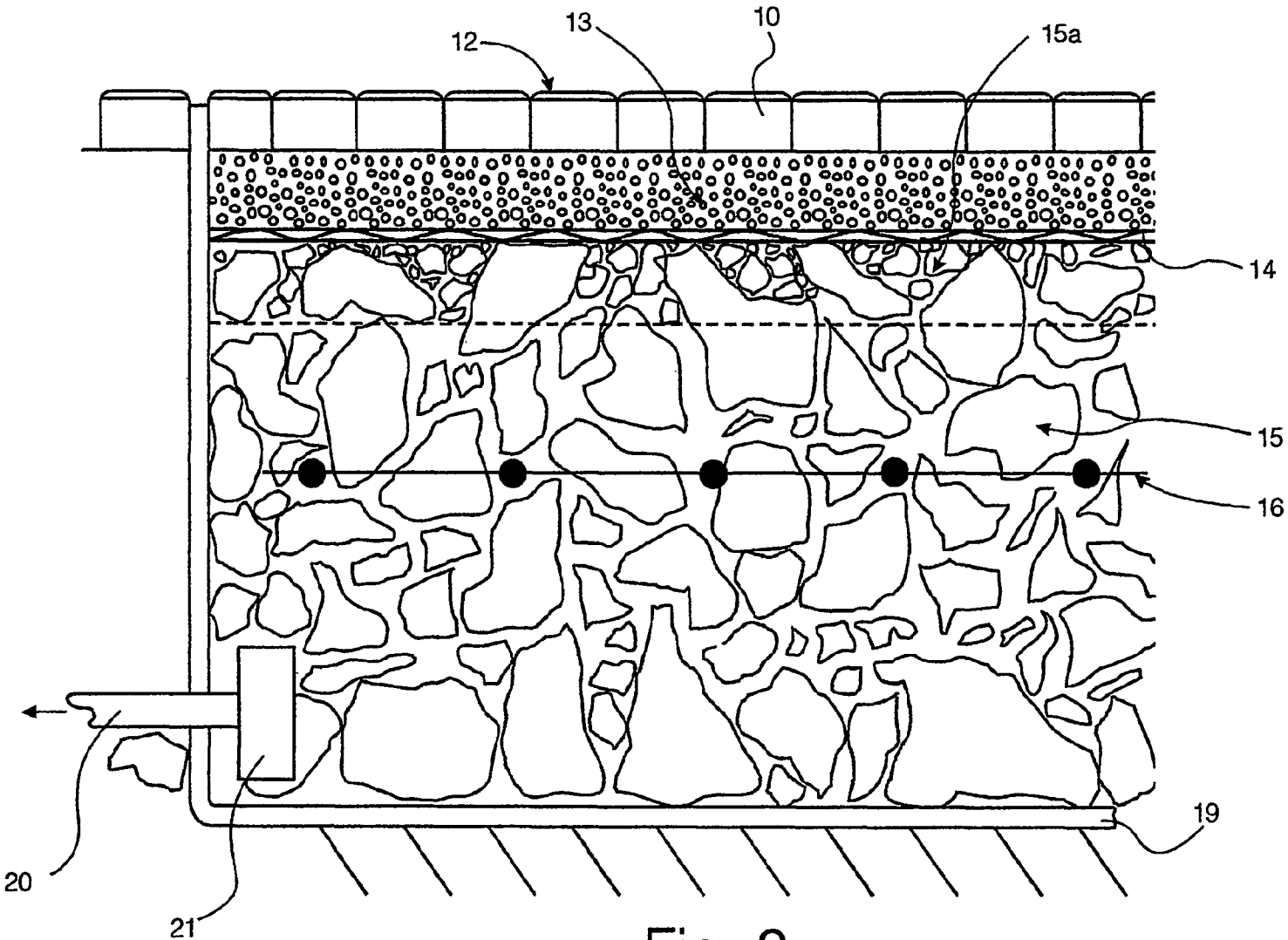
FIG. 2 is a cross section through part of an alternative embodiment of the invention adapted as a source of recirculated water for storage or reuse or for controlled discharge into sewers or streams.

The collection of water for recycling can be enhanced by utilising the embodiment of FIG. 2 which largely corresponds to that of FIG. 1 except that the geotextile 17 at the interface between the sub-base 15 and the sub-grade 18 is replaced by an impermeable membrane 19 which, as well as underlying the sub-base 19 also passes up the sides to the surface, terminating flush with the upper surface of the wear layer 12. An outlet pipe 20 from a manifold collector 21 then allows the water contained in the reservoir constituted by the sub-base 15 to be delivered for such secondary purpose as is appropriate.

Figure 3:
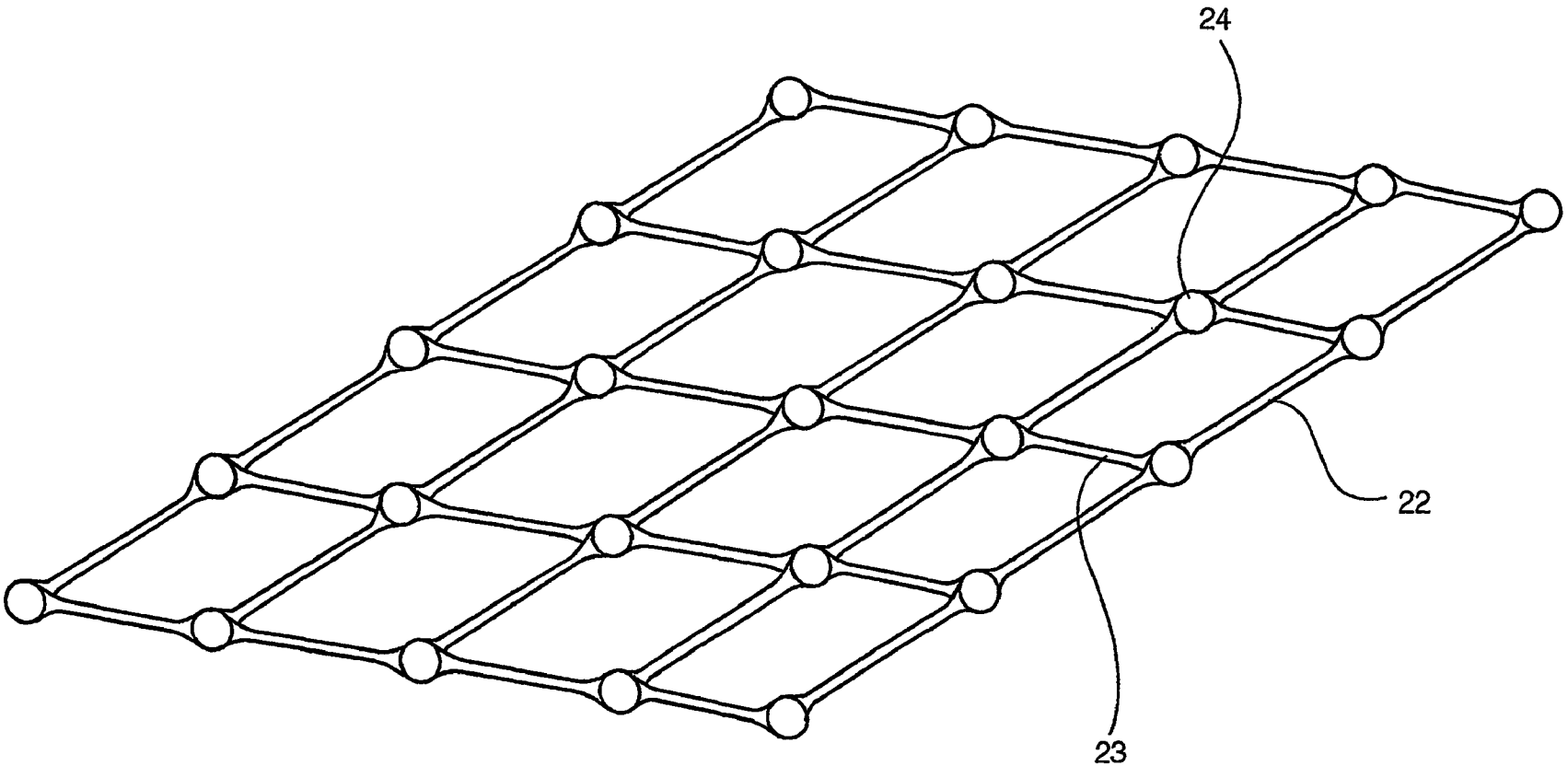
FIG. 3 is a perspective view of a grid suitable for use in the pavement structure of the present invention.
Figure 4:
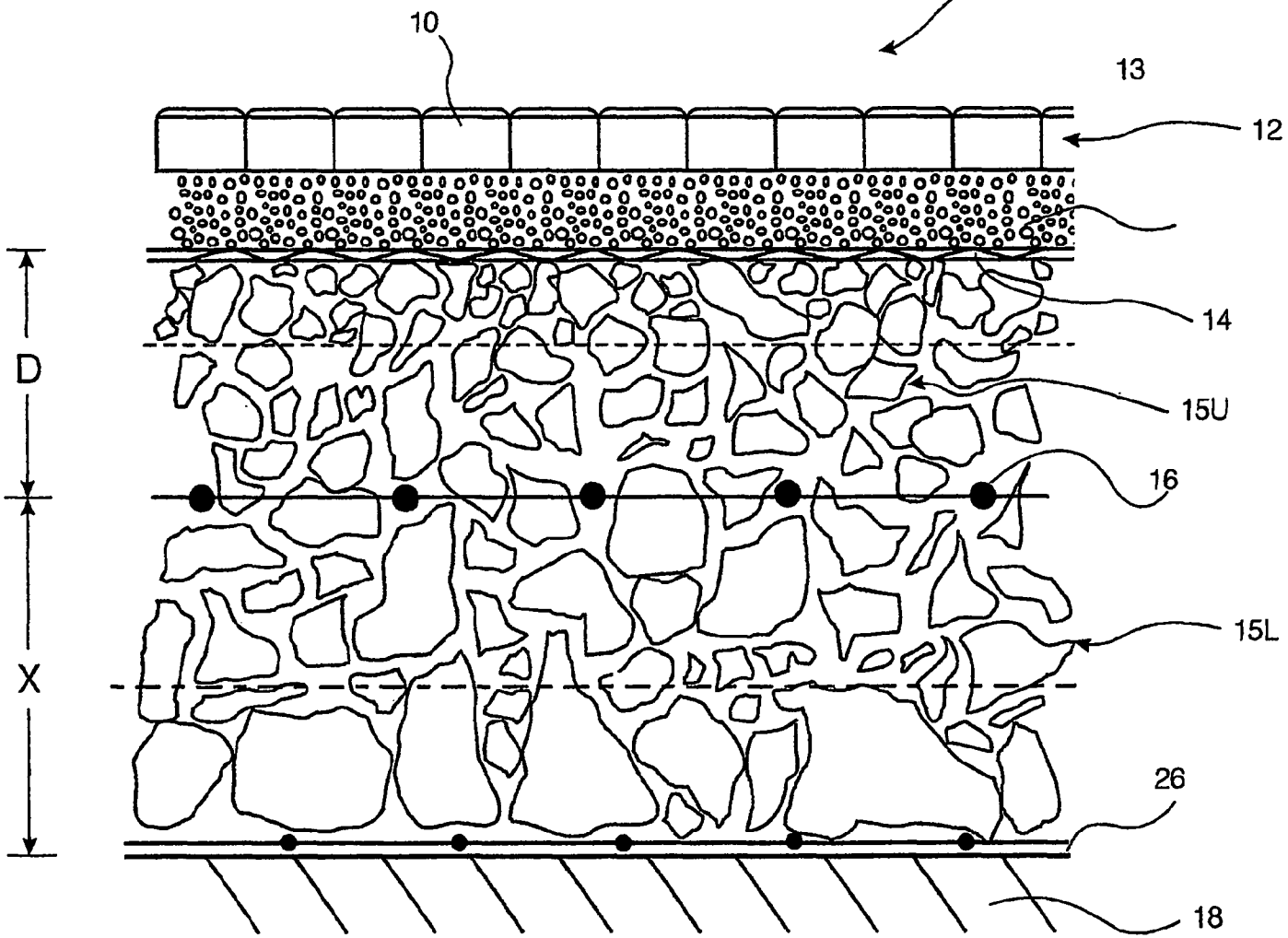
FIG. 4 is a cross section through a part of a further alternative, and presently preferred, embodiment of the invention.

FIG. 3 illustrates a typical geogrid suitable for use in the paving structure of the invention. It comprises a monolithic grid-like structure of longitudinal ribs 22 separated by regularly spaced lateral or transverse ribs 23. At the nodes or junctions between ribs there is an enlarged boss 24 and the ribs are stretched after moulding to orientate the molecules and increase the tensile strength thereof Another, presently preferred, embodiment is illustrated in FIG. 4. In this Figure the same reference numerals have been used to identify the same or corresponding components as in the embodiments of FIGS. 1 and 2. In this embodiment, however, the parts of the sub-base formed above and below the intermediate geogrid 16 although of the same material are in different size ranges, the lower sub-base layer 15L being formed of stone in the range 63 mm to 10 mm and the upper layer 15U being in the range 20 mm to 5 mm. In each case the stone is evenly graded, that is to say there is a roughly equal proportion of stone of all sizes within the size range and no preponderance of, say, the larger or the smaller end of the range. In this embodiment the largest stones are somewhat smaller, even in the lower layer, than those used in the embodiments of FIGS. 1 and 2, and the smallest fraction is above 10 mm whereas in the embodiment of FIG. 1 up to 5% of the material could be less than 10 mm.

The geotextile 17 at the interface of the sub-base with the sub-grade of the FIG. 1 embodiment is replaced with a geogrid 27 which may have the same properties as the geogrid 16 illustrated in FIG. 3.

The invention claimed is:

1. A permeable paving structure comprising:

a permeable surface wear layer for bearing the weight of vehicular traffic;

an underlying permeable sub-base layer of rigid insoluble hard particulate material within a defined size range , said sub-base layer being permeable and forming part of a system for collecting and one of retaining and detaining rainfall or other precipitation falling on said paving structure; and a reinforcing grid located at an intermediate level within said underlying permeable sub-base layer, said reinforcing grid being located at a depth within said permeable sub-base layer not less than one and a half times the dimension of the largest particles in that part of said permeable sub-base layer above said reinforcing grid and lying between said reinforcing grid and said permeable wear layer.

2. A paving structure according to claim 1, wherein the reinforcing grid is located at a level not less than one half of the thickness of said underlying sub-base layer from the top thereof.

3. A paving structure according to claim 1, wherein there is provided a second reinforcing grid of interconnected elements at a lower level than said reinforcing grid.

4. A paving structure according to claim 1, wherein the size of the grid openings is not greater than the size of the largest of the particles of said underlying sub-base layer.

5. A paving structure according to claim 1, wherein the grid size is close to the mean value of the size of the particles in said underlying sub-base layer.

6. A paving structure according to claim 1, wherein the grid size is substantially 40% of the maximum particle size of said underlying sub-base layer.

7. A paving structure according to claim 1, wherein the material of the underlying sub-base layer comprises non-rounded angular particles with well defined edges of crushed gravel, rock or concrete in a size range of up to 100 mm with not more than 5% thereof being less than 10 mm.

8. A paving structure according to claim 1, wherein not less than 40% of the material of said underlying sub-base layer lies in the range 37.5 mm to 100 mm.

9. A paving structure according to claim 1, wherein not more than 70% of the material of said underlying sub-base layer lies in the range 37.5 mm to 100 mm.

10. A paving structure according to claim 1, wherein the sub-base layer below said reinforcing grid is composed of particulate material in a generally larger size range than that in the layer above said reinforcing grid.

11. A paving structure according to claim 10, wherein the largest particles of the particulate material in the sub-base layer below said reinforcing grid are substantially three times larger than the largest of articles in the sub-base layer above the reinforcing grid.

12. A paving structure according to claim 11, wherein the smallest particles in the sub-base layer below said reinforcing grid are not less than twice the size of the smallest particles in the sub-base layer above the reinforcing grid.

13. A paving structure according to claim 10, wherein the material of the lower sub-base layer comprises non-rounded angular particles with well defined edges of crushed gravel, rock or concrete in a size range from about 63 mm to about 10 mm.

14. A paving structure according to claim 13, wherein the material of the upper sub-base layer comprises non-rounded angular particles with well defined edges of crushed gravel, rock or concrete in a size range from about 20 mm to about 5 mm.

15. A paving structure according to claim 1, wherein a laying course in the form of an intermediate layer of particulate material lies between the surface or wear layer and said underlying sub-base layer, the particulate material of said intermediate layer being of smaller dimension than that of said underlying sub-base layer.

16. A paving structure according to claim 15, wherein the average particle size of the material in the said intermediate layer is less than the average particle size of the elements of said underlying sub-base layer.

17. A paving structure according to claim 16, wherein the average particle size of the intermediate layer is in the range 2 mm–10 mm.

18. A paving structure according to claim 1, wherein the particulate material of said underlying sub-base layer has a minimum 10% fines value of 150 K/n.

19. A paving structure according to claim 1, wherein the material of said underlying sub-base layer is substantially non-plastic.

20. A paving structure according to claim 1, wherein said reinforcing grid is one having a substantially rectangular grid structure extending in two orthogonal directions with substantially the same resistance to stress in each of said two orthogonal directions.

21. A reinforced paving structure according to claim 1, wherein the grid is a polymeric plastics material composed of a plurality of links or ribs joined together at intersections to form a substantially laminar sheet.

22. A paving structure according to claim 1, wherein an upper stratum of said underlying layer has an additional component of particles the maximum dimension of which is a fraction of the maximum dimension of the largest particles in said underlying sub-base layer.

23. A paving structure according to claim 22, wherein said fraction is not greater than 60% of the size of the largest particles in said underlying sub-base layer.

24. A paving structure according to claim 15, wherein the surface wear layer is composed of individual elements or blocks laid on the intermediate layer with no grouting, sand or other filling between them or between them and the intermediate layer, said blocks having means defining drainage channels.

25. A paving structure according to claim 16, wherein the average particle size of the intermediate layer is about 5 mm.

26. A paving structure according to claim 22, wherein said fraction is not greater than 40% of the size of the largest particles in said underlying sub-base layer.

27. A paving structure according to claim 22, wherein said fraction is not greater than 20% of the size of the largest particles in said underlying sub-base layer.

28. A paving structure according to claim 22, wherein said fraction is not less than 15% of the size of the largest particles in said underlying sub-base layer.

29. A paving structure according to claim 17, wherein the average particle size of the intermediate layer is about 5 mm.

30. A paving structure according to claim 15, wherein the surface wear layer is composed of individual elements or blocks laid on the intermediate layer, said blocks having means defining drainage channels and include dressing of clean stone not greater than 3 mm overlaid and worked into said drainage channels.

* * * * *